US006692226B1

(12) United States Patent
Cheng

(10) Patent No.: US 6,692,226 B1
(45) Date of Patent: Feb. 17, 2004

(54) VIBRATION-PROOF FASTENER FOR A RADIATOR

(76) Inventor: Tsung-Hsien Cheng, P.O. Box 697, Feng-Yuan City, Taichung Hsien (TW), 420

( * ) Notice: Subject to any disclaimer, the term of this patent is extended or adjusted under 35 U.S.C. 154(b) by 70 days.

(21) Appl. No.: 10/147,471

(22) Filed: May 17, 2002

(51) Int. Cl.[7] ..... F04D 29/64

(52) U.S. Cl. ..... 415/119; 415/214.1; 415/220; 411/903

(58) Field of Search ..... 415/119, 213.1, 415/214.1, 220; 411/512, 903, 907, 508, 913

(56) References Cited

U.S. PATENT DOCUMENTS 2,442,754 A * 6/1948 Beam ..... 411/907

5,316,423 A * 5/1994 Kin ..... 411/907

* cited by examiner

*Primary Examiner*—Edward K. Look
*Assistant Examiner*—Richard A. Edgar

(57) ABSTRACT

A vibration-proof fastener for a radiator includes a pair of housings and a motor fan each of which has four thru holes adjacent four corners. A double-headed fastener has a shank engagable with the thru holes of the motor fan with a metal pith axially wrapped in the center and a pair of diametrically enlarged heads symmetrically formed at two ends. The heads each have an annular groove to define a pair of clamping flanges made engagable with the thru holes of the housings, a dome outer end and a conical portion connecting the head with the shank. The expansion of the fastener by heat from the motor will prevent the vibrations and noises to appear in the radiator.

3 Claims, 5 Drawing Sheets

VIBRATION-PROOF FASTENER FOR A RADIATOR

BACKGROUND OF THE INVENTION

The present invention relates to fasteners and more particularly to a vibration-proof fastener for a radiator.

A radiator is indispensable to a computer and/or other appliances for radiating the heat therein. A typical radiator (as shown in FIG. 1) comprises a fan 1 driven by a motor 2 which are fastened to a housing 4 by bolts 3 and nuts 7 through the thru holes 5 and 6 in the housing 4 and the fan 1 (as shown in FIG. 2). When the radiator operates for a certain period of time, the motor 2 begins to create heat which becomes higher and higher and gradually diffuses to all the components of the radiator. Because the metallic bolts 3 and the plastic housing 4 have different expansion coefficients, a clearance t appears between each of the bolts 3 and the thru holes 5 and 6 of the fan 1 and the housing 4 (as shown in FIG. 3), thus causing vibrations and noise in the radiator. The bolts 3 may be finally loosened after a long time of operation.

SUMMARY OF THE PRESENT INVENTION

The present invention has a main object to provide a vibration-proof fastener for a radiator which fastener is made of a flexible material that will cause no vibrations and/or noise when it is adapted to fasten the fan to the housing.

Accordingly, the vibration-proof fastener for a radiator of the present invention comprises generally a double-headed fastener made of a flexible material. The fastener has a shank, a metal pith wrapped in the shank for reinforcement purposes, a diametrically enlarged head at each end of the shank being symmetrically formed each including a conical portion connecting the head to the shank, an annular groove to define a pair of clamping flanges on two sides and a dome outer end. When in use, the fastener is squeezedly inserted through the thru holes of the motor fan and then the heads are respectively squeezed into the thru holes of the housing until the grooves of the heads are tightly engaged with the edge of the thru holes of the housing. Although, the components are expanded by the heat from the motor, there will be no clearance between the fastener and the housing so as to cause no vibrations and noise therebetween.

The present invention will become more fully understood by reference to the following detailed description thereof when read in conjunction with the attached drawings.

DETAILED DESCRIPTION OF THE PREFERRED EMBODIMENT

Figure 1:
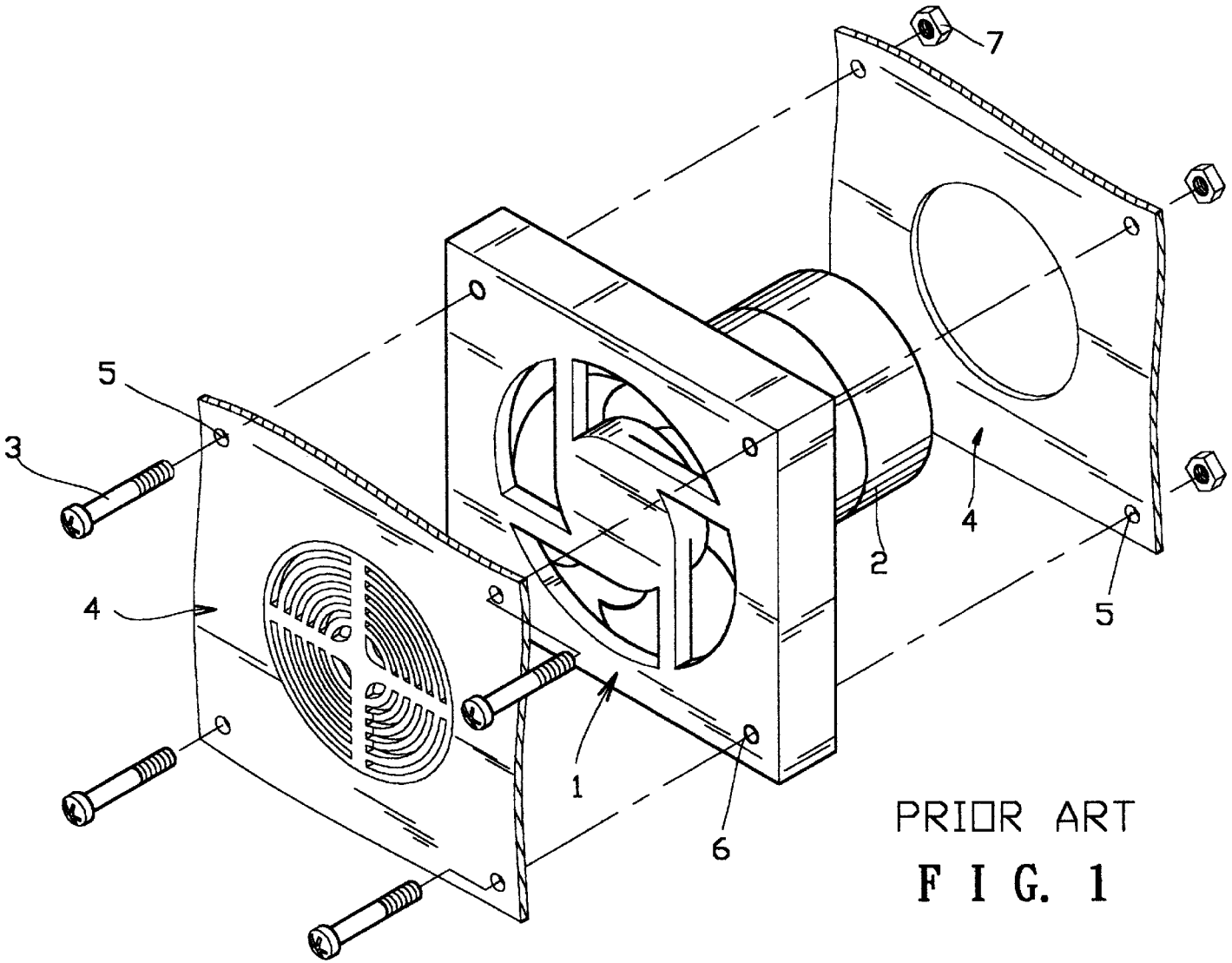
PRIOR ART FIG. 1
FIG. 1 is an exploded perspective view of a radiator fastened by the metallic bolts and nuts according to the prior art.
Figure 2:
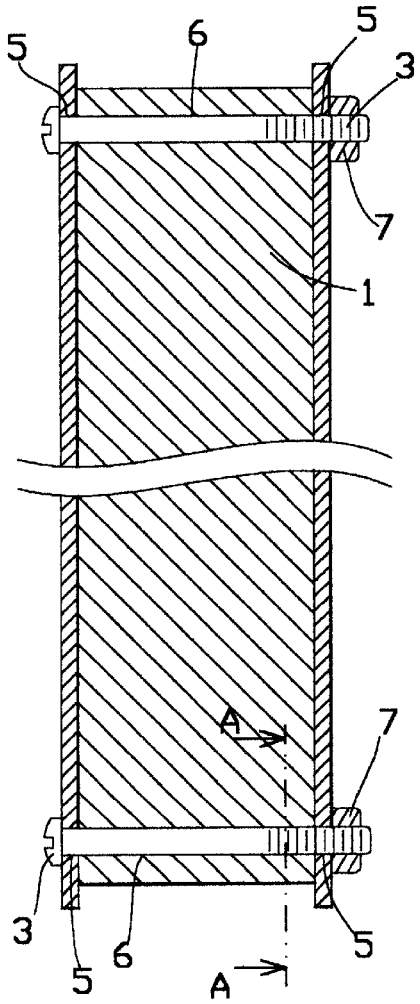
PRIOR ART F I G. 2
FIG. 2 is a sectional view of FIG. 1.
Figure 3:
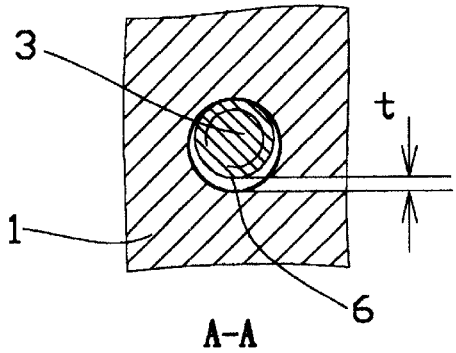
PRIOR ART F I G. 3
FIG. 3 is a cross-sectional view taken along line A—A of FIG. 2.
Figure 4:
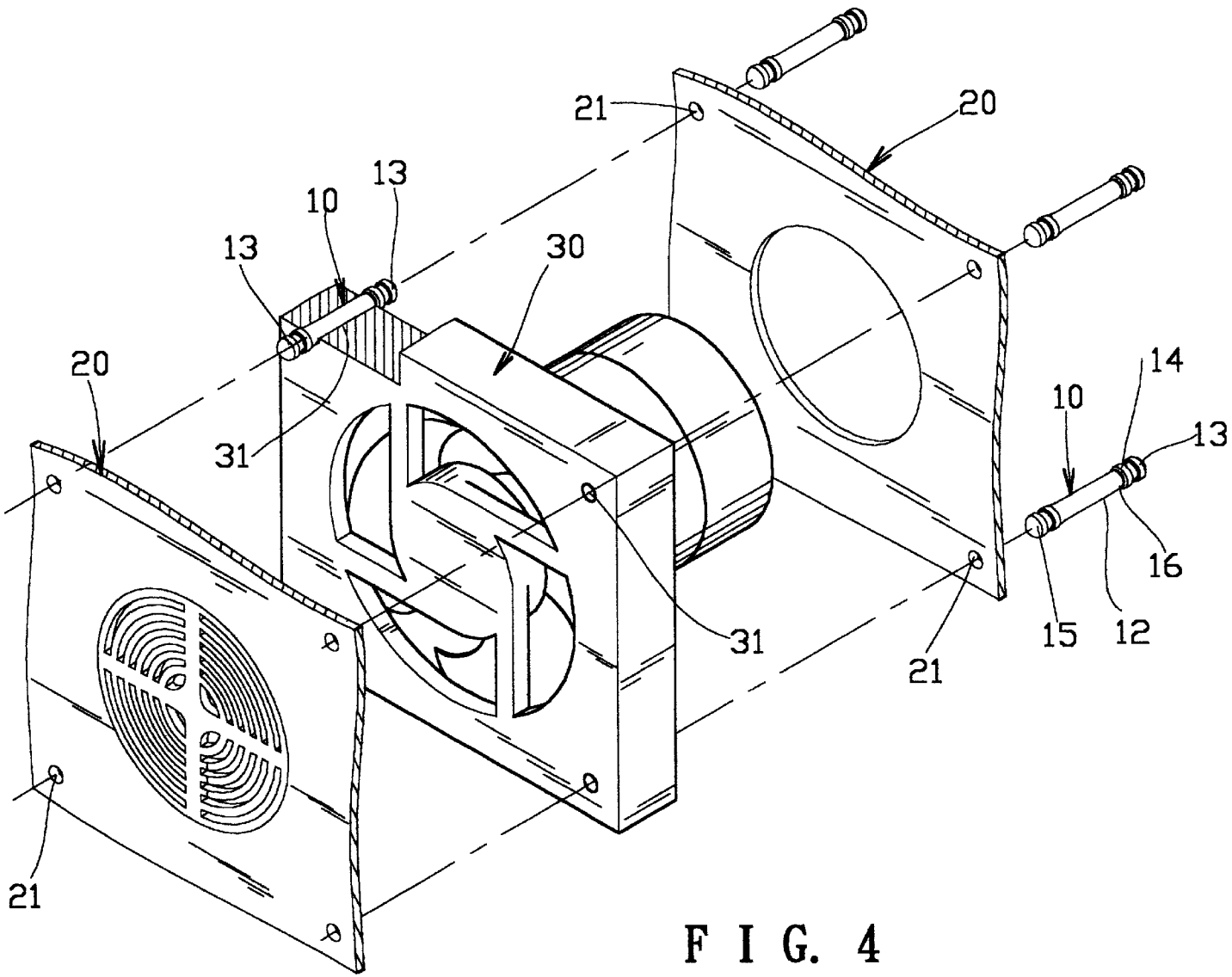
FIG. 4 is an exploded perspective view to show the preferred embodiment according to the present invention.
Figure 5:
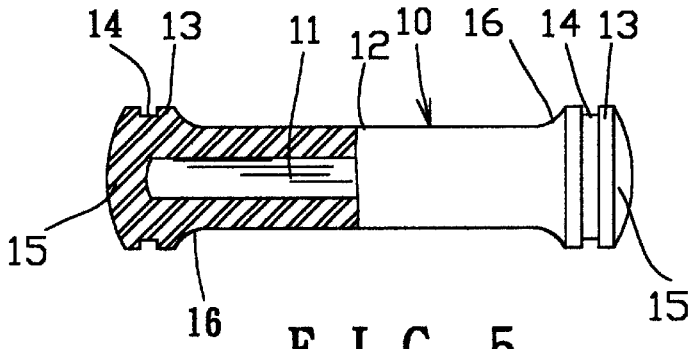
FIG. 5 is a perspective view with a partially sectional view to show a double-headed fastener of the present invention.

With reference to FIGS. 4 and 5 of the drawings, the vibration-proof fastener for a radiator of the present invention comprises generally a plurality of double-headed fasteners 10 and a radiator which is composed of a pair of housings 20 and a motor fan 30 secured together by the fastener 10.

The fasteners 10 are made of flexible material and each has a cylindrical shank 12 in the length equal to the thickness of the motor fan 30, a metal pith 11 axially wrapped in the center of the shank 12 for reinforcement purposes and a diametrically enlarged head 13 at each end of the shank 12. The heads are symmetrically formed and each has an annular groove 14 to define a pair of clamping flanges on two sides, a dome outer end 15 and a conical portion 16 between the shank 12 and the head 13.

The housings 20 each have four first thru holes 21 adjacent four corners and the motor fan 30 has four second thru holes 31 adjacent four corners made engagable with the first thru holes 21 of the housings 20.

Figure 7:
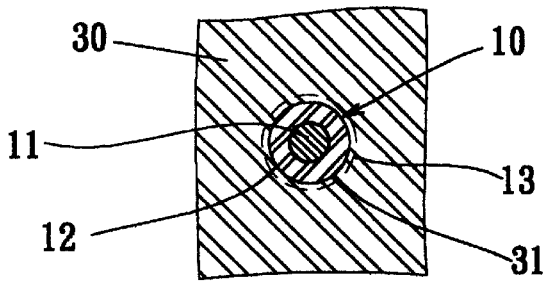
FIG. 7 is a cross-sectional view of the shank of the double-headed fastener engaged with a thru hole of the motor fan.
Figure 8:
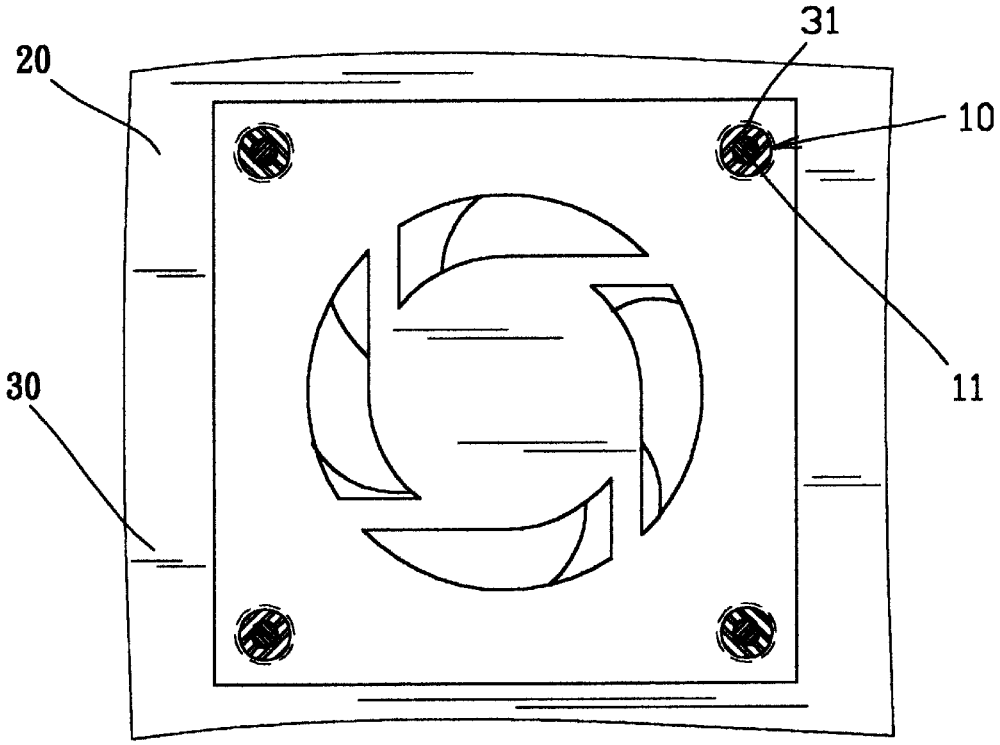
FIG. 8 is a elevational view to show that the motor fan is fastened to a housing.
Figure 6:
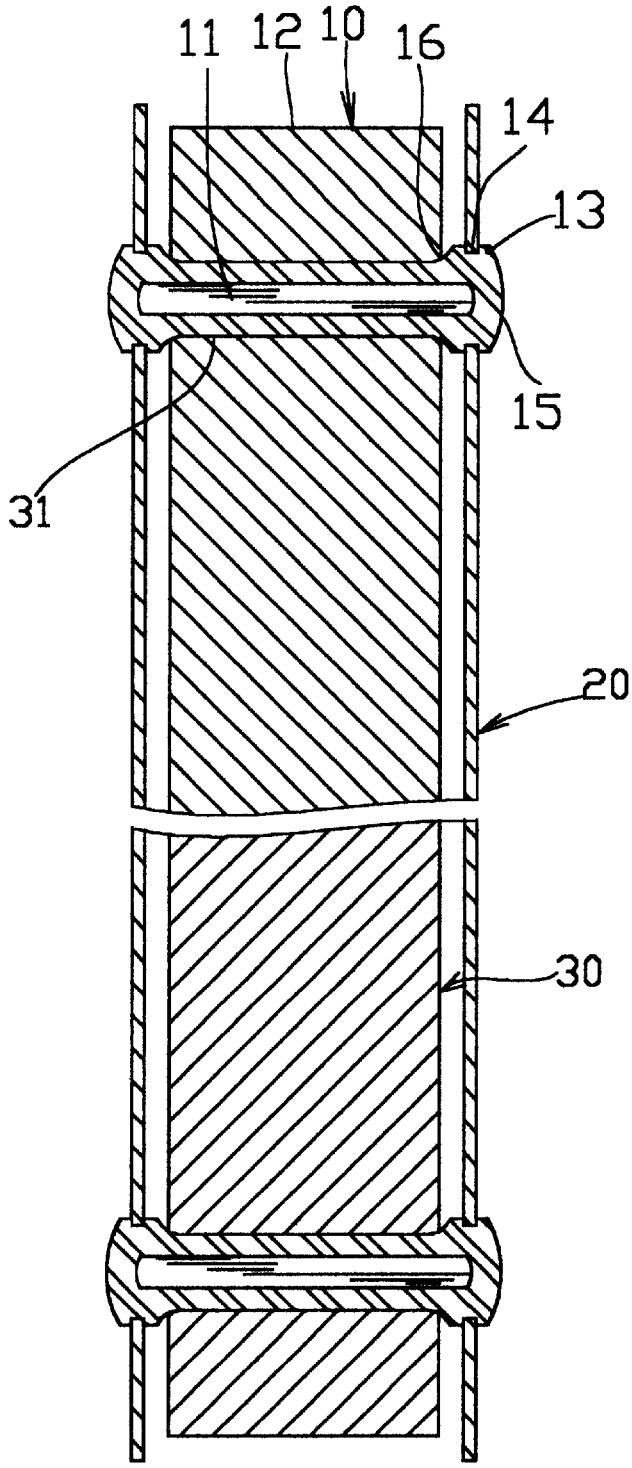
FIG. 6 is a sectional view to show that the double-headed fasteners are used to fasten the motor fan to a housing.

Referring to FIGS. 6, 7 and 8, when assembling, first squeeze the heads 13 of the fasteners 10 into the first thru holes 21 of one of the housings 20 to have the annular grooves 14 and the clamping flanges of the heads 13 respectively engaged with the edges of the first thru holes 21 ,then squeeze the other ends of the fasteners 10 through the second thru holes 31 of the motor fan 30 to have the shank 12 of the fasteners 10 completely engaged within the second thru holes 31 and then squeeze the other heads 13 of the fasteners 10 into the first thru holes 21 of another housing 20 to have the annular grooves 14 and the clamping flanges respectively engaged with the edges of the first thru holes 21. Note that the squeezing of the head 13 through the first and second thru holes 21 and 31 is very easy and convenient because of the dome outer end 15 and the flexible material which provide a great elasticity to the heads 13. Further, the conical portions 16 of the head 13 at two ends of the second thru holes 31 of the motor fan 30 have their functions to enforce the shank 12 inside the second thru hole 31 to be very tight and leaves no clearance therebetween.

When the motor is operated for a certain period of time, the heat from the motor becomes higher and higher and diffuses to other components in the radiator so that both of the double-headed fastener 10 and the housings 20 begin to expand. However, the more expansion of the fastener 10 and the housings 20, the engagement between the shank 12 and second thru hole 31, the groove 14 and the first thru hole 21 becomes tighter, so that no vibrations and/or noises appear. Further, the conical portion 16 of the head 13 can limit the lateral movement of the motor fan 30 and leaves no clearance therebetween.

Note that the specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. A vibration-proof fastener for a radiator comprising: a pair of housings each having four first thru holes adjacent four corners; a motor fan having four second thru holes adjacent four corners made engagable with the first thru holes of said housings; a double-headed fastener having a shank engagable with the second thru holes of said motor fan, a metal pith axially wrapped in the center of the shank, a pair of diametrically enlarged heads respectively connected to two ends of the shank, said heads being symmetrically formed and each having an annular groove to define a pair of clamping flanges engagable with the first thru holes of said housings, a dome on an outer end and a conical portion connecting said heads to said shank; whereby the expansion of said fastener by heat of the motor will prevent vibrations and noises in said radiator.

2. The vibration-proof fastener as recited in claim 1 wherein said fastener is made of a flexible material.

3. The vibration-proof fastener as recited in claim 1 wherein said shank has a length equal to the thickness of said motor fan.

* * * * *